US009398681B2

(12) United States Patent
Tantawi et al.

(10) Patent No.: US 9,398,681 B2
(45) Date of Patent: Jul. 19, 2016

(54) DISTRIBUTED COUPLING HIGH EFFICIENCY LINEAR ACCELERATOR

(71) Applicant: The Board of Trustees of the Leland Stanford Junior University, Palo Alto, CA (US)

(72) Inventors: Sami G. Tantawi, Stanford, CA (US); Jeffrey Neilson, Redwood City, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 120 days.

(21) Appl. No.: 14/207,376

(22) Filed: Mar. 12, 2014

(65) Prior Publication Data

US 2014/0191654 A1 Jul. 10, 2014

Related U.S. Application Data

(63) Continuation of application No. 13/947,043, filed on Jul. 20, 2013, now abandoned.

(60) Provisional application No. 61/674,262, filed on Jul. 20, 2012.

(51) Int. Cl.

| | |
|---|---|
| ***H05H 9/04*** | (2006.01) |
| ***H05H 7/02*** | (2006.01) |
| ***H05H 7/18*** | (2006.01) |

(52) U.S. Cl.

CPC . *H05H 9/04* (2013.01); *H05H 7/02* (2013.01); *H05H 7/18* (2013.01); *H05H 9/044* (2013.01)

(58) Field of Classification Search

None

See application file for complete search history.

(56) References Cited

PUBLICATIONS

Neilson J et al SLAC Pub 15008 Design of RF Feed system for standing wave accelerator structures 14$^{th}$ advanced accelerator concepts workshop AIP Conference proceedings VOI 1299 pp. 463-466 Nov. 2010.*

J Neilson et al "Desing of RF Feed System for standing wave accelerator structures" PRoceedings of IPAC 2011 San Sebastian Spain. MPC072 p. 244-246.*

Neilson, J. et al., SLAC-PUB-15008, published as "Design of RF Feed System for Standing-Wave Accelerator Structures," Advanced Accelerator Concepts: 14th Advanced Accelerator Concepts Workshop. AIP Conference Proceedings, vol. 1299, pp. 463-466 (Nov. 2010).

S. Tantawi, SLAC-PUB-12104, published as"RF Distribution System for a Set of Standing-Wave Accelerator Structures", Phys. Rev. St Accel. Beams, vol. 9, Issue 11, 2006.

Neilson, J. et al., SLAC-PUB-15242, published as "Design of RF Feed System for Standing-Wave Accelerator Structures," Proceedings, 2nd International Conference, IPAC 2011, San Sebastian, Spain, Sep. 4-9.

* cited by examiner

*Primary Examiner* — Douglas W Owens
*Assistant Examiner* — Srinivas Sathiraju
(74) *Attorney, Agent, or Firm* — Lumen Patent Firm

(57) ABSTRACT

A microwave circuit for a linear accelerator includes multiple monolithic metallic cell plates stacked upon each other so that the beam axis passes vertically through a central acceleration cavity of each plate. Each plate has a directional coupler with coupling arms. A first coupling slot couples the directional coupler to an adjacent directional coupler of an adjacent cell plate, and a second coupling slot couples the directional coupler to the central acceleration cavity. Each directional coupler also has an iris protrusion spaced from corners joining the arms, a convex rounded corner at a first corner joining the arms, and a corner protrusion at a second corner joining the arms.

5 Claims, 8 Drawing Sheets

DISTRIBUTED COUPLING HIGH EFFICIENCY LINEAR ACCELERATOR

CROSS-REFERENCE TO RELATED APPLICATIONS

This application is a continuation-in-part of U.S. patent application Ser. No. 13/947,043 filed Jul. 20, 2013, which claims priority from U.S. Provisional Patent Application 61/674,262 filed Jul. 20, 2012, both of which are incorporated herein by reference.

STATEMENT OF GOVERNMENT SPONSORED SUPPORT

This invention was made with Government support under contract DE-AC02-76SF00515 awarded by Department of Energy. The Government has certain rights in this invention.

FIELD OF THE INVENTION

The present invention relates generally to linear accelerators. More specifically, it relates to improved microwave linear accelerators.

BACKGROUND OF THE INVENTION

A linear particle accelerator (linac) accelerates charged particles using a series of oscillating electric potentials generated by RF cells joined together to form a linear beamline. At one end of the linac, the particles from a particle source are injected into the beamline using a high voltage. The typical design process for a linear accelerator requires careful consideration of the coupling parameters between adjacent cells. These structures are fed from one single point or input guide and the power flows from that point to all cells through coupling holes which typically also serve as the beam tunnel for the particles being accelerated. Coupling between cells limits the ability of designers to optimize the cell shape for efficiency (high shunt impedance) and power and gradient handling capability.

SUMMARY OF THE INVENTION

In one aspect, this invention provides a topology for independently feeding each cell, or group of cells, in the accelerator structure. The theoretical idea of feeding each cavity is old; however, until now there has been no practical implementation that allows such topology to exist. Meeting this long-standing need, this invention provides a practical implementation of a microwave circuit that is capable of separately feeding individual or multiple cavities. This circuit is designed in such a way that the coupling between cavities is minimized, or nearly minimized. This was previously thought to be impractical due to the required size of the directional couplers, microwave bends and RF loads needed to implement the circuit which all has to fit within the distance between two adjacent cells. This distance is typically less than one half of the RF wavelength.

In one aspect, the present invention provides several new topologies for microwave linear accelerators that allow the optimization of the individual cavities without the constraint usually applied to the coupling between adjacent cavities. This has the benefit of more efficient designs that consumes less RF power, i.e., it allows for an enhanced optimization of the so-called shunt impedance that is the amount of power required for a given accelerator gradient. Hence, the overall cost of building a linear accelerator system for any application is substantially reduced. Furthermore, being able to optimize the accelerator structure shape without the constraint imposed by coupling between the cells allow the optimization process to be geared towards low surface electric and magnetic field and hence more reliable high gradient operation. It has been known for a while that the n-mode structure could be designed with high efficiency. However, this can only work for a small number of cells because of the mode density problems associated with small coupling between cells—a feature required for efficient operation. This problem is currently addressed by the use of bi-periodic structure configurations. In these configurations, an additional set of cavities are inserted either in-line or on the side of the structure to facilitate coupling between cells, ending up with a structure that looks like a $\pi$ mode from the beam point of view but behaves like a $\pi/2$ structure from a circuit point of view. These structures work well but they have a serious drawback: the losses consumed in the in-line cavities or the side cavities reduces the shunt impedance especially in the case of moderate to heavy beam loading. Furthermore, when using the inline cavity configuration the space consumed by the cavity reduces the gradient and reduces the efficiency. In the case of the side coupled cavities the coupling slots associated with each cavity also are expensive and limit the high gradient operation because of the magnetic field enhancement leading to surface fatigue.

Embodiments of this invention allow for the simple realization of the efficient $\pi$-mode structure without the drawbacks mentioned above. We eliminate the need for either the types of coupling cavities by, in the first embodiment of this invention feeding each cavity by a compact directional coupler, and in the second embodiment by a symmetrical distribution system. The RF coupling in either case has no resonant structures and hence is highly efficient.

In the first case it also provides an implementation of ideas proposed by one of the inventors, and for which the reflection to the source is eliminated. The second implementation has all the waveguide in the distribution system oriented such that the small dimensions of the waveguide oriented along the accelerator structures radial direction. This orientation minimizes the structure volume and complexity, allowing for lighter and more compact implementation.

According to one embodiment, a microwave circuit is provided having compact, tolerance insensitive, directional couplers, compact E-plane bends, and multiple azimuthal feeds from a single feed.

According to another embodiment, a microwave circuit is provided having a distribution waveguide with its width designed to provide appropriate phase shift between feed arms, where each of the feed arms has two slots feeding two separate short accelerator sections (e.g., each section may have four cavities), where two slots in each feed arm provide a natural 180 degree phase shift between the two fed accelerator section due to the nature of the fundamental mode in the waveguide representing these feed arms. This is ideal for the efficient $\pi$-mode accelerator structure. The short circuit length at the end of the feed arm is roughly the guide wavelength divided by four. It is designed this way to maximize the coupling at the slots and hence minimize the size of the slot perturbing the accelerator cavity which contains these slots. Short circuit length at the end of the distribution waveguide designed to make an equal distribution of power between arms.

Any application for a linear accelerator could benefit from this invention because it reduces RF power requirements due to the possibility of optimization of cell shape without undue concern about the coupling between cells, and hence reduces the cost associated with the RF power sources needed for these linacs, and it allows for the implementation of linac structures in a much shorter distance because of the high gradient capabilities of this invention, which is due to the possibility of optimizing the cell shapes for high gradient operation without constraint imposed by cell to cell coupling In particular, embodiments of the invention have commercial application in medical electron accelerators, medical proton accelerators, high energy lepton accelerators for future colliders, high energy hadron accelerators for accelerator driven systems for nuclear fission power stations, future light sources either for compactness or for the capability to operate at high repetition rate efficiently, and accelerator for active interrogation systems for national security.

Accelerators according to the present invention provide a more efficient accelerator structure than others known in the art. Also they are capable of handling high gradient fields which provide compactness of the structures. Both those two features can lead to cost effective systems.

DETAILED DESCRIPTION

Figure 1:
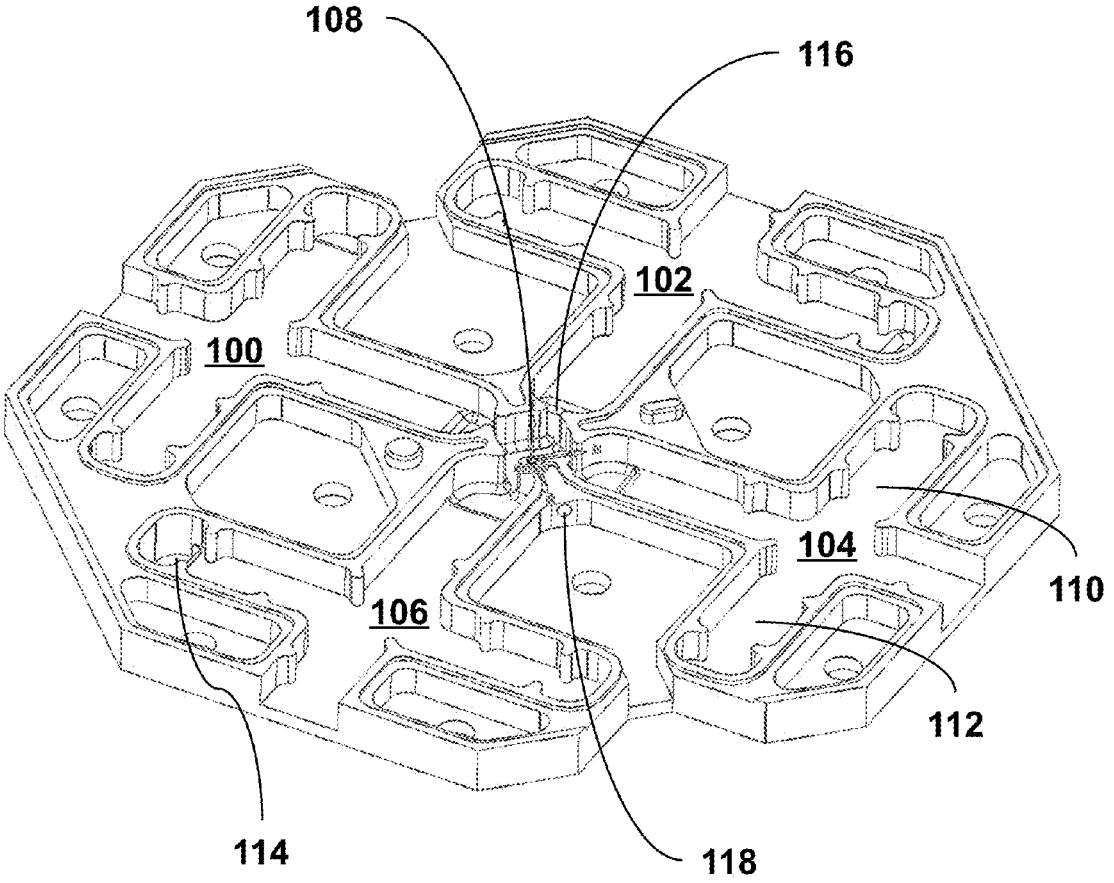
FIG. 1 is an illustration of a linear accelerator RF cell with four directional coupler feeds according to an embodiment of the invention.

FIG. 1 is an illustration of a monolithic metallic linac cell plate according to an embodiment of the invention. A microwave circuit for a linear accelerator may be formed by stacking multiple such cell plates upon each other. The cell has four cross-shaped directional couplers 100, 102, 104, 106 symmetrically oriented around an acceleration cavity 108 that is aligned with a vertical beam axis of the linear accelerator. Each directional coupler 100, 102, 104, 106 has coupling arms. For example, coupler 104 has arms 110 and 112. Each coupling arm has an in-plane width less than an operational wavelength of the linear accelerator. Each of the cell plates has one or more coupling slots, such as slot 114, that couples one of the directional couplers in the cell to an adjacent directional coupler of an adjacent cell. Each of the cell plates also has one or more coupling slots, such as slot 116, that couples the directional coupler to the central acceleration cavity 108. The cell plate also includes a cavity tuning access hole 118.

The topology of the cell provides a microwave circuit that allows the implementation of the feeding system within the distance between two adjacent cells. In this figure the H-plane directional couplers are oriented in the plane normal to the acceleration which allows the coupler to be implemented in a distance less than the cell length. Also, the topology allows connecting the different directional couplers that feed the cells through a serpentine E-plane waveguide bend that also fits within the cell length. The fact that all cells are being fed through a directional coupler increases isolation between cavities and the freedom to optimize their shape for higher gradient and shunt impedance.

Figure 2:
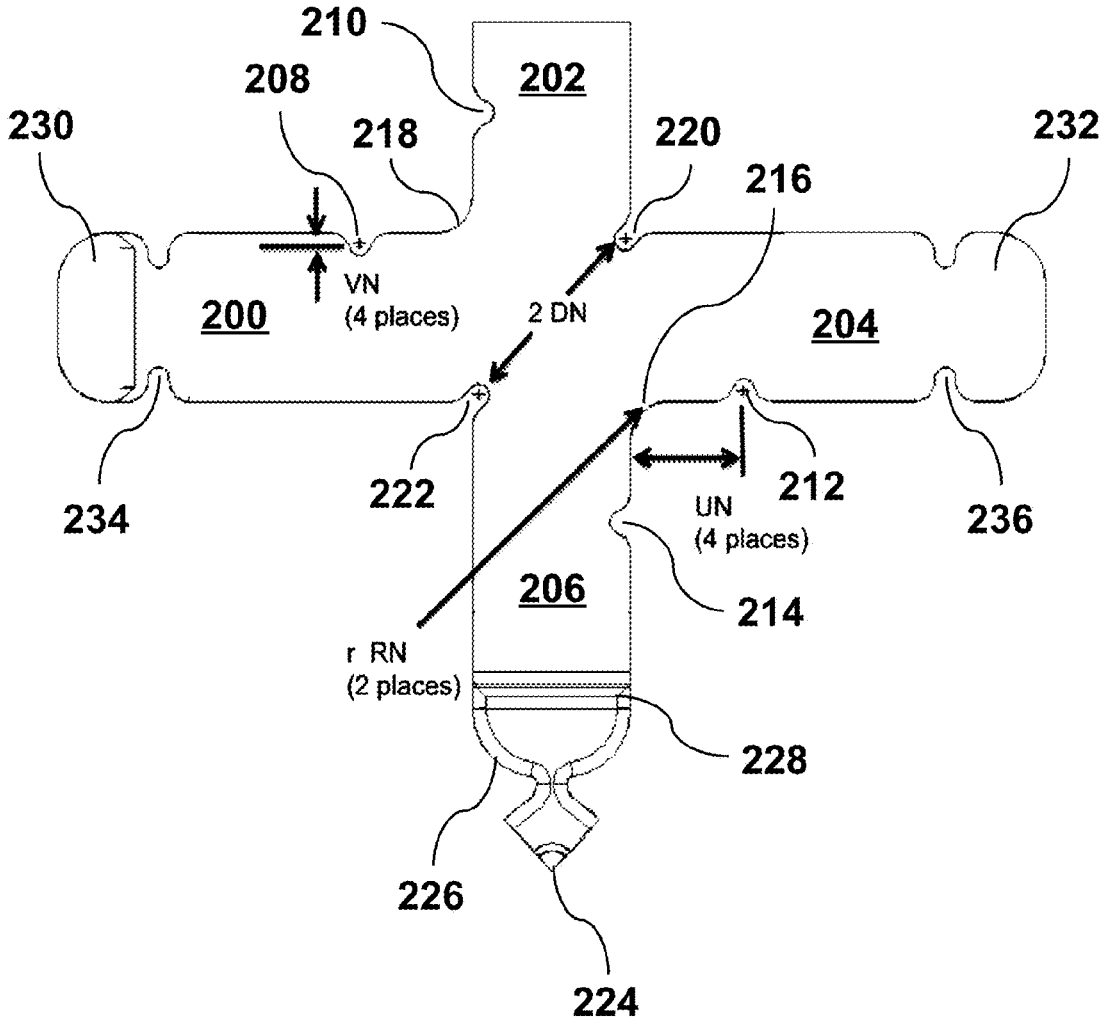
FIG. 2 is an illustration of a directional coupler according to an embodiment of the invention.

FIG. 2 is a parameterized model of a directional coupler according to an embodiment of the invention. This compact, tolerance insensitive, H-plane directional coupler has a 2D topology that can be produced in a single machining operation. Preferably, the cell plates are composed of high purity oxygen-free copper. The coupler has four arms 200, 202, 204, 206. Load arm 202 at the top of the figure is opposite lower arm 206 which couples to the beam tunnel 224 via a taper 226 to match the waveguide to cavity coupling slot and a step 228 in waveguide height to maintain mechanical structural integrity. The two side arms 200, 204 each have elbow coupling regions 230, 232 defined by matching irises 234, 236 formed by protrusions 234, 236 from the walls. The side arms 200 and 204 have minimum lengths of ½ the waveguide wavelength to eliminate interaction between irises.

The wall of each arm has a protrusion VN 208, 210, 212, 214 forming an iris whose height is selected to minimize reflection and maximize directivity. These protrusions are positioned on alternating sides of the arm walls, and the spacing UN between the protrusions and the corners joining the arms is selected to minimize reflection and maximize directivity. UN and VN are coupled to simultaneously minimize reflection and maximize directivity. The corners joining the arms are of two types. Rounded corners RN 216, 218 have a convex curvature viewed from inside the cell and are positioned diagonally opposite each other. The other two corners DN 220, 222 have protrusions into the cell that are selected to set forward the coupling factor. The RN protruding feature and the shifting by UN of the VN protruding feature away from the corners, greatly reduces the sensitivity of the cell to machining tolerances, making it finally practical to build the cell within required tolerances.

Figure 3:
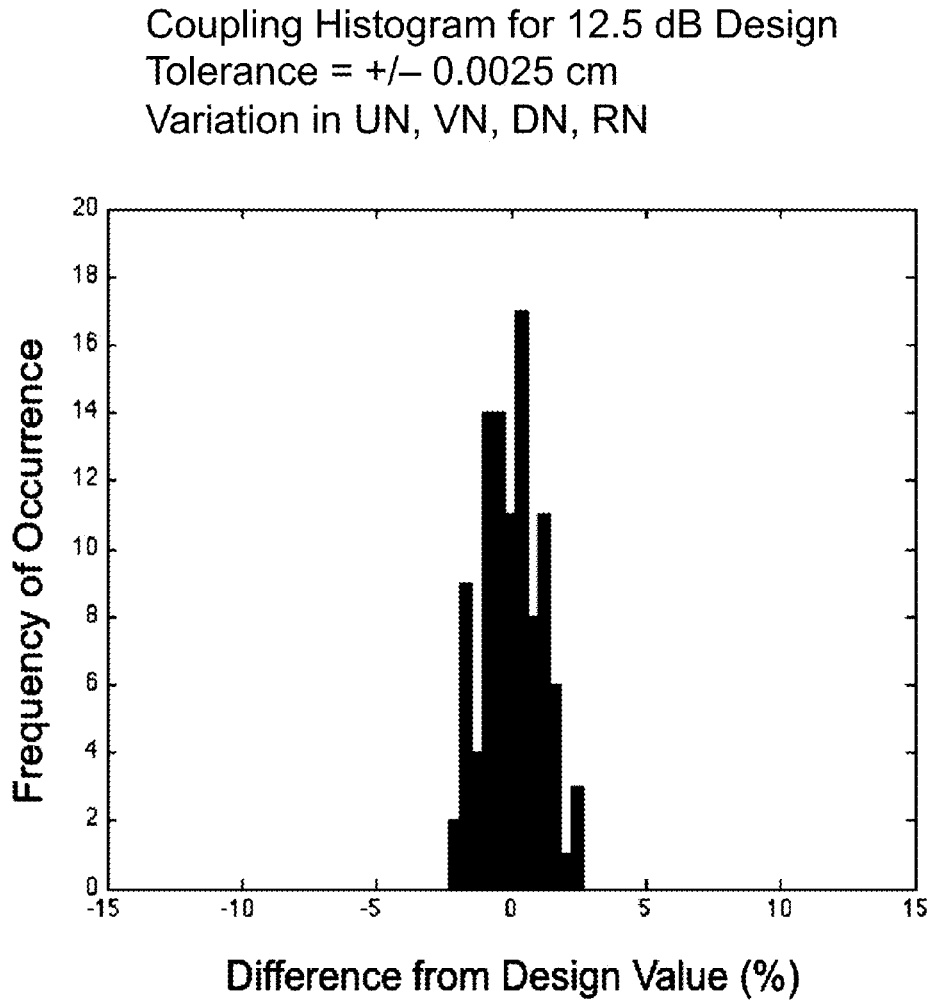
FIG. 3 is a graph of frequency of occurrence vs. difference from design value resulting from a Monte-Carlo simulation of the sensitivity of the coupler to the four design parameters according to an embodiment of the invention.

The design of the coupler can be characterized by the four parameters: UN, VN, DN, RN. For example, the dimensions of a directional coupler with a coupling factor of 3 dB are UN=21.857 mm, VN=3.418 mm, DN=13.350 mm, RN=3.537 mm, and the dimensions for 4.77 dB are UN=16.320 mm, VN=1.586 mm, DN=14.930 mm, RN=5.143 mm. FIG. 3 shows a Monte-Carlo simulation of the sensitivity of the coupler to random variation of the four design parameters.

Figure 4:
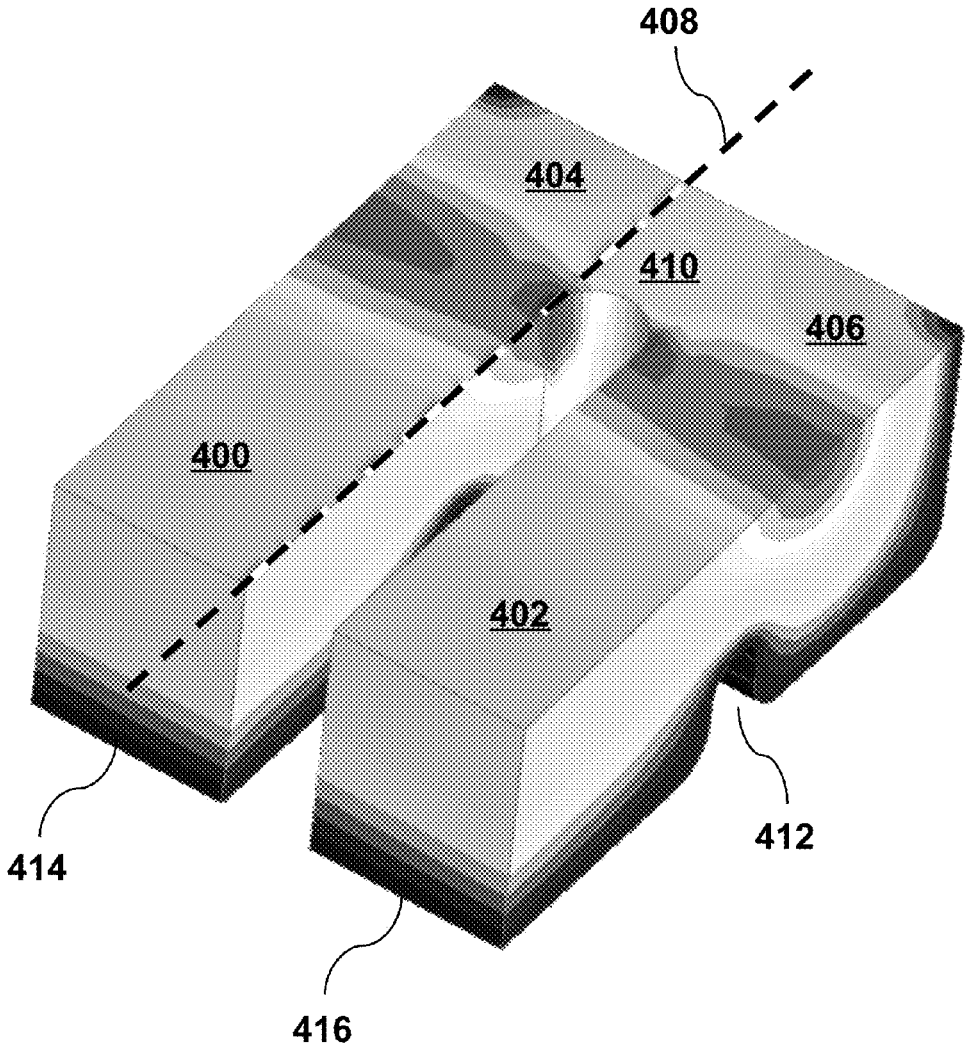
FIG. 4 is an illustration of an E-plane bend where the different shades depict different electric field intensities, and where the coupler is split down middle of bend along beam axis, and the dashed line indicates second half of coupler on following plate, according to an embodiment of the invention.

FIG. 4 is an isometric view detailing side arms 400, 402 and corresponding coupling regions 404, 406 for two stacked directional couplers, implementing an E-plane bend, according to an embodiment of the invention. The different shades depict different electric field intensities, and the coupler is split down the middle of the bend along the beam axis. The dashed line 408 indicates the dividing line between cell plates. Region 410 is the coupling slot between these adjacent plates (corresponding to slot 114 of FIG. 1). Protrusion 412 is the matching iris for the elbow. Ends 414, 416 are output and input arms, respectively, to their respective cells. In contrast with conventional bends that require a 3D machining operation, this implementation of the E-plane bend can be produced by primarily a 2D machining operation.

Figure 5:
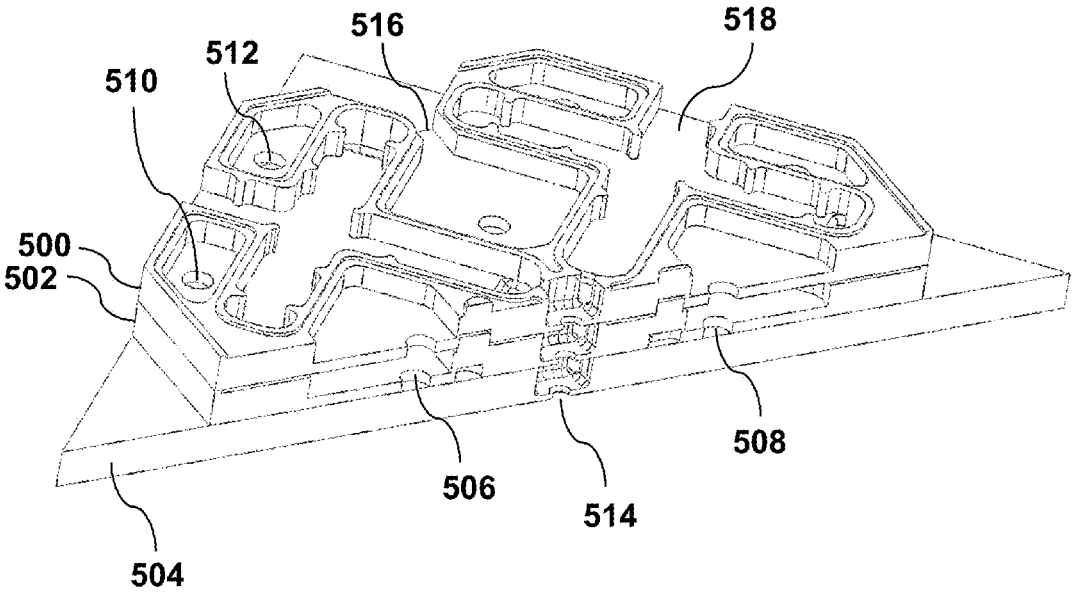
FIG. 5 illustrates a stack of cell plates split in half along beam axis, according to an embodiment of the invention.

FIG. 5 is an isometric cut-away view of a stack of multiple cell plates 500, 502 stacked on a structure plate 504, according to an embodiment of the invention. The structure includes cooling channels 506, 508, 510, 512. At the center is the beam tunnel 514. Also shown are cavity tuning access slot 516 and load arm 518 of one of the directional couplers. This figure illustrates the topology that appears when cells described above in relation to FIGS. 1-4 are combined. The whole structure of each cell can be machined from a single planar block of metal. A stack of these blocks then forms the accelerator with the RF distribution network.

Figure 6:
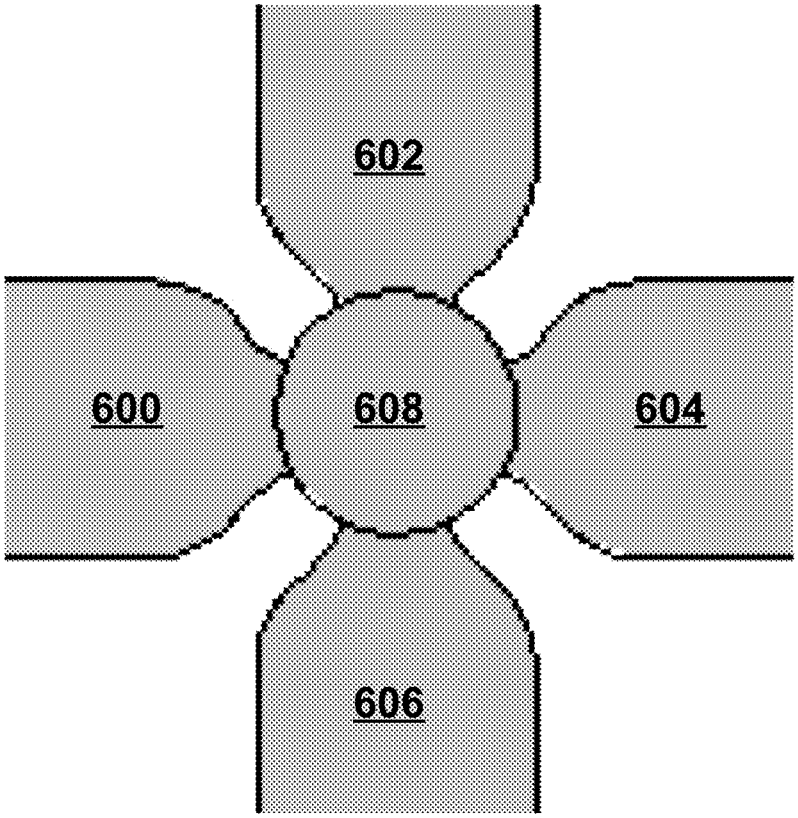
FIG. 6 illustrates a cell with four coupling arms to minimize RF driven quadrupole moments, according to an embodiment of the invention.

FIG. 6 is a top view of a cell 608 with four coupling arms input ports 600, 602, 604, 606 to minimize RF driven quadrupole moments, according to an embodiment of the invention. Cell 608 has a coupling slot contour to minimize pulse heating and peak magnetic field. This input coupler allows up to four azimuthally distributed parallel fed networks. Although all the figures describe a structure that has four parallel feeds for the cells, the topology presented could be implemented for one, two, three or four parallel feeds, depending on the application. The advantage of the four feed geometry is it cancels both dipole and quadrupole RF field distortion within the cell. This may not be necessary for all applications of a linear accelerator. However, it is described here in its full complexity that would allow any application of a linear accelerator to use this invention.

It should be noted that several sections (i.e., several stacks of cells) with this topology could be connected together with a small offset between the sections to yield a superstructure. The distance between sections then can be adjusted to cancel the reflection to the source. Hence the system would act like a travelling-wave structure from the RF source's point of view, and will have all the advantages of a standing wave accelerator structure.

Figure 7A:
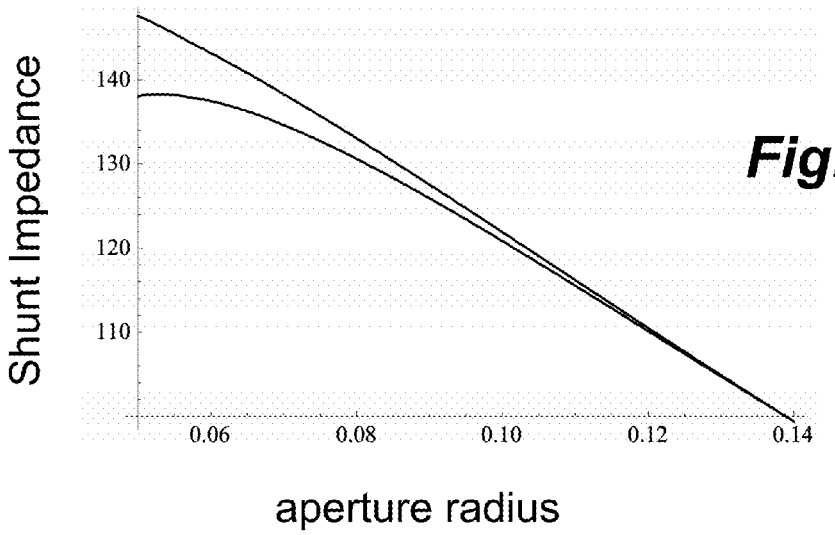
FIG. 7A is a graph illustrating shunt impedance as a function of the aperture radius, where the top curve is for a single isolated cavity, and the bottom curve is for the maximum number of cavities that can be fed with one feed, according to an embodiment of the invention.
Figure 7B:
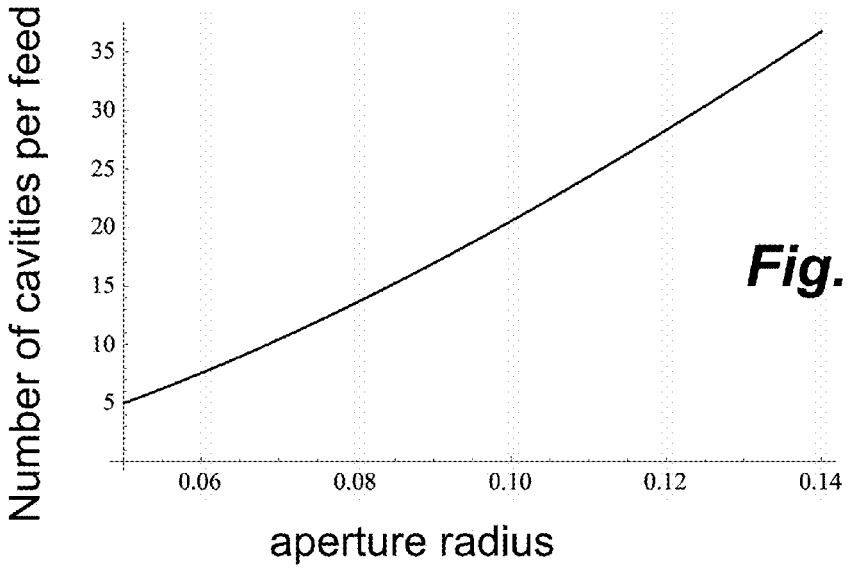
FIG. 7B is a graph illustrating the number of cavities vs. aperture radius, according to an embodiment of the invention.

In some embodiments, it is possible to feed the structure every few cells to reduce the cost of the structure. A significant part of the advantage of this structure can be retained while increasing the number of cells per feed arm from every individual cell to multiple cells. Despite an increase in the number of cells fed per feed arm, the shunt impedance would be very high. This is demonstrated in FIGS. 7A and 7B which show an analysis of the shunt impedance versus number of cells being fed. Specifically, FIG. 7A is a graph illustrating shunt impedance as a function of the aperture radius, where the top curve is for a single isolated cavity, and the bottom curve is for the maximum number of cavities that can be fed with one feed. FIG. 7B is a graph illustrating the number of cavities per feed vs. aperture radius. The analysis depicted in these figures assumes that the number of cells that are being fed by a single feed arm is limited by the axial modal density. Hence, the number is determined by the proximity of the $\pi$ mode to the $\pi-1$ mode, and the need for this separation to be more than the band width determined by the quality factor of the $\pi$-mode. The analysis is done for cavities operating at 11.424 GHz, but of course can be done at any other frequency as well to yield similar results.

It should be noted that this design can be used for injector sections where the particle speed is less than the speed of light. This will provide an ideal topology for these sections. Furthermore, this will work with heavy particle such as protons and ions.

Figure 8A:
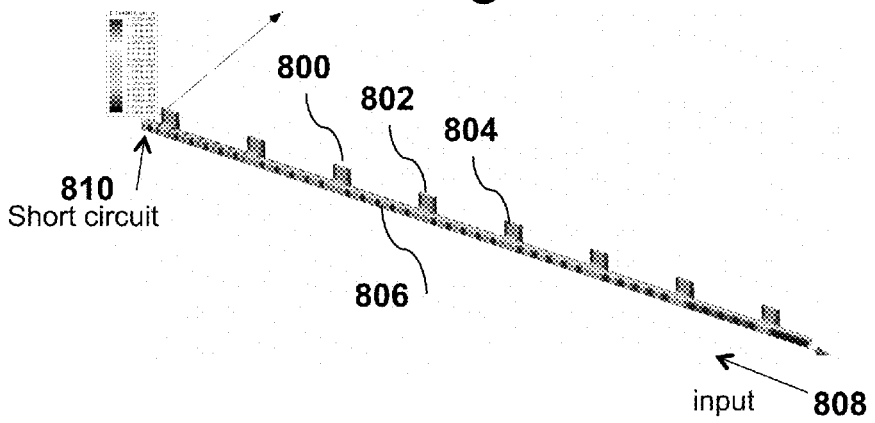
FIGS. 8A and 8B illustrate a compact RF distribution system with feed arms, each feeding two accelerator sections simultaneously with π-phase shift between them, according to an embodiment of the invention.
Figure 8B:
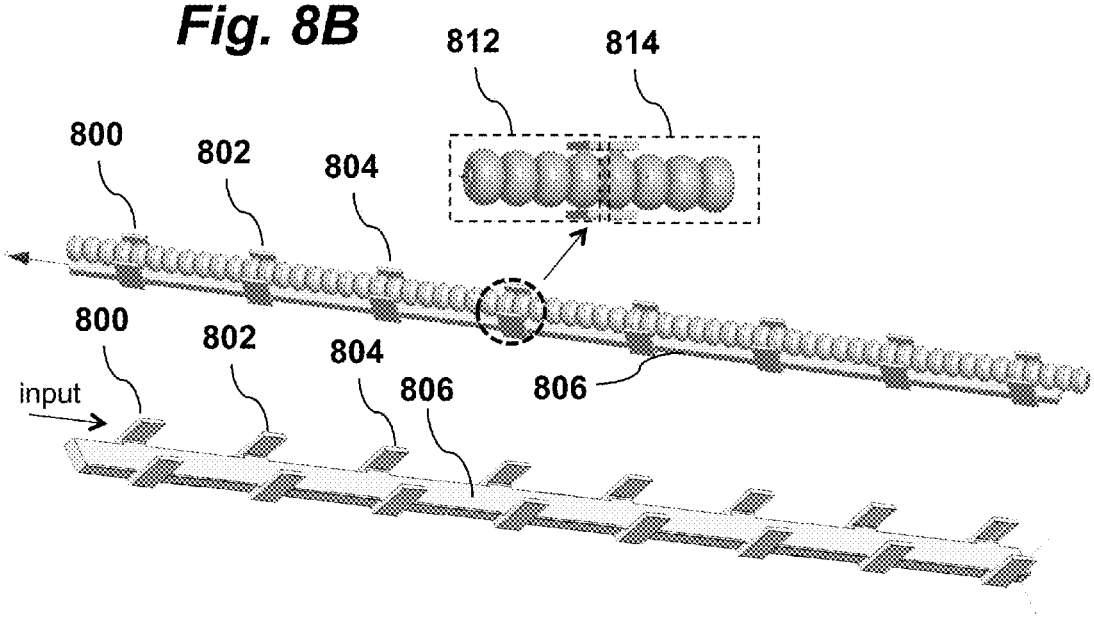

In some embodiments, the distribution between cavities can be provided with a tap-off instead of directional couplers, hence simplifying the system further. In this case the cavities will be coupled, and this needs to be taken into account in the design. One possible implementation of these tap-offs is shown in FIGS. 8A and 8B, which illustrate a compact RF distribution waveguide 806 with feed arms 800, 802, 804, each feeding two accelerator sections simultaneously with $\pi$-phase shift between them. The arms are all fed by a parallel waveguide 806 that provides appropriate phase shift between feed arms and distributes the power equally between all the arms. Indeed it is always possible to achieve this equal distribution of power between arms using a translationally symmetric distribution; i.e., each arm of the distribution system is coupled to the distribution wave guide with the same coupling features and with the same coupling coefficient. The distance between the arms 800, 802, 804, would allow for either equal phases or alternating phases with 180 degree phase shift between arms. This will allow for a great flexibility in the design. The input 808 is shown at one end of waveguide 806. Finally, the position of the short circuit 810 at the opposite end of the distribution waveguide 806 is adjusted and placed to create the appropriate standing wave pattern allowing for this equal coupling with the appropriate phase shift and equal distribution of power between arms. The short circuit length at the end of the feed arm is roughly the guide wavelength divided by four. It is designed this way to maximize the coupling at the slots and hence minimize the size of the slot perturbing the accelerator cavity which contains these slots. The feed arms 800, 802, 804 may be implemented as symmetrical pairs to eliminate dipole field components. A feed arm with two slots feeds two separate short accelerator sections (each section comprises four cavities in this particular example). Note that due to the nature of the fundamental mode in the feed arm waveguide there is a natural 180 degree phase shift between the two fed accelerator sections 812, 814. This is ideal for the efficient $\pi$-mode accelerator structure.

This design uses a waveguide with its narrow wall along the radial direction of the structure, which allows for compact mechanical structure. Then a dual tap-off from each side allow followed by an E-plane bend provide the feed to two sections of the accelerator structure simultaneously through two coupling slots. Note that the feeding waveguide field has an odd symmetry around the two coupling slot, and hence its perfectly aligned to feed the $\pi$-mode of a standing wave accelerator structure. This way one can feed a number of accelerator structure sections with only series of tap-offs that are half that number of sections fed; thus reducing the mechanical complexity of the overall structure. Note also that it is possible to design the overall tap-off network from identical tap-offs separated by an integer number of free space wavelength. At the same time the amplitude of the output signal at each tap off is equal and the phases of the output of the tap-offs are equal. Just as well one could have designed the system with a $\pi$-phase shift between outputs to feed every odd number of cavities rather than even, the case shown in FIG. 8B. Finally note that the position of the short-circuit at the end of the distribution system plays a crucial role in the design and have to be chosen carefully to achieve this performance.

Since the structures are applicable to devices at different frequencies, dimensions of the cavities, couplers and plates are determined relative to the operational wavelength or frequency. Cavities have a length of approximately one half wavelength and a diameter of approximately 4.2 $c/2\lambda f$, where c is the speed of light and f is the frequency. The coupling arms that form the coupler preferably have a width W such that $\lambda/2<W<\lambda$, where $\lambda$ is the wavelength. The plates preferably have a thickness equal to the cavity length.

The invention claimed is:

1. A microwave circuit for a linear accelerator, the microwave circuit comprising multiple monolithic metallic cell plates, a distribution waveguide, and a sequence of feed arms;

wherein the cell plates are stacked upon each other and grouped to form a sequence of cell sections;

wherein each of the feed arms has two slots coupled symmetrically on opposite sides of the distribution waveguide, wherein the two slots are coupled to adjacent cell sections.

2. The microwave circuit of claim 1 wherein each of the feed arms is designed to provide equal power and appropriately correlated phases to the adjacent cell sections.

3. The microwave circuit of claim 1 wherein each of the feed arms has a short circuit length equal to a quarter of a waveguide wavelength.

4. The microwave circuit of claim 1 wherein each of the cell sections has four cells.

5. A microwave circuit for a linear accelerator, the microwave circuit comprising multiple monolithic metallic cell plates, a distribution waveguide, and a sequence of feed arms;

wherein the cell plates are stacked upon each other and grouped to form a sequence of cell sections;

wherein each of the feed arms has a short circuit length equal to a quarter of a waveguide wavelength;

wherein each of the feed arms has two slots coupled symmetrically on opposite sides of the distribution waveguide, wherein the two slots are coupled to adjacent cell sections.

* * * * *